US011087722B2

(12) United States Patent
Hara

(10) Patent No.: US 11,087,722 B2
(45) Date of Patent: Aug. 10, 2021

(54) HUMIDITY MODIFYING AUXILIARY TOOL, HUMIDITY MODIFYING MEMBER, AND METHOD FOR MODIFYING HUMIDITY

(71) Applicant: TECHNAD CO., LTD, Gifu (JP)

(72) Inventor: Masumi Hara, Gifu (JP)

(73) Assignee: TECHNAD CO., LTD, Gifu (JP)

( * ) Notice: Subject to any disclaimer, the term of this patent is extended or adjusted under 35 U.S.C. 154(b) by 0 days.

(21) Appl. No.: 16/937,207

(22) Filed: Jul. 23, 2020

(65) Prior Publication Data

US 2020/0357366 A1 Nov. 12, 2020

Related U.S. Application Data

(63) Continuation of application No. PCT/JP2019/007933, filed on Feb. 28, 2019.

(30) Foreign Application Priority Data

Mar. 1, 2018 (JP) ..... JP2018-036189

(51) Int. Cl.
*G10D 3/00* (2020.01)
*G10D 1/08* (2006.01)
*G10G 7/00* (2006.01)

(52) U.S. Cl.
CPC ..... *G10D 3/00* (2013.01); *G10D 1/08* (2013.01); *G10G 7/00* (2013.01)

(58) Field of Classification Search
CPC ..... G10D 3/00; G10D 1/08; G10G 7/00
See application file for complete search history.

(56) References Cited

U.S. PATENT DOCUMENTS 4,649,793 A * 3/1987 Blackshear ..... G10D 3/00 84/453

FOREIGN PATENT DOCUMENTS

JP S54-151395 U 10/1979
JP 2016-206552 A 12/2016

OTHER PUBLICATIONS

International Search Report issued in PCT/JP2019/007933 dated May 21, 2019 with English Translation (4 pages).

* cited by examiner

*Primary Examiner* — Kimberly R Lockett
(74) *Attorney, Agent, or Firm* — Nakanishi IP Associates, LLC

(57) ABSTRACT

A humidity modifying auxiliary tool having a superior humidity modifying effect is provided. A humidity modifying auxiliary tool capable of being installed in a condition where the humidity modifying auxiliary tool covers a sound hole provided on a body part of a stringed instrument includes: a lid portion capable of covering the sound hole; a frame portion provided at a back side of the lid portion, the frame portion being equipped with a humidity modifying sheet retaining portion to retain a humidity modifying sheet to modify humidity of the body part.

4 Claims, 10 Drawing Sheets

HUMIDITY MODIFYING AUXILIARY TOOL, HUMIDITY MODIFYING MEMBER, AND METHOD FOR MODIFYING HUMIDITY

CROSS-REFERENCE TO RELATED APPLICATIONS

This application is a continuation application of International Patent Application No. PCT/JP2019/007933 filed on Feb. 28, 2019, which claims priority to Japanese Patent Application No. 2018-036189 filed on Mar. 1, 2018, the entire contents of which are incorporated by reference.

TECHNICAL FIELD

The present invention relates to a humidity modifying auxiliary tool being installed so as to cover a sound hole (so-called a resonance hole) provided on a body part of a stringed instrument such as a guitar, violin and the like, a humidity modifying member, and to a method for modifying humidity using these.

BACKGROUND

A body part (body) of stringed instruments such as an acoustic guitar, classical guitar, folk guitar and the like is formed by assembling a wood material into a box shape. Since this wood material is extremely thin, it is easily affected by humidity during storage and the like. When the body part of the stringed instrument is affected by humidity, the shape of the surface plate and the angle of the neck can change, and in the worst scenario, cracks can occur in the body part (body), thereby impeding a person from playing the stringed instrument.

In order to solve such problems, the applicants have suggested a humidity modifying sheet for musical instruments having a size and shape which can cover a sound hole of a guitar. The humidity modifying sheet is provided with a notch portion and a tag portion, and these are inserted inside the body part of the guitar from the sound hole, thereby installing the humidity modifying sheet to the guitar (Patent Document 1).

CITATION LIST

Patent Literature

[Patent Literature 1] JP 2016-206552A

SUMMARY OF THE INVENTION

Technical Problem

However, the humidity modifying sheet for musical instruments disclosed in the afore-mentioned Patent Literature 1 was unable to sufficiently prevent cracks occurring in the body part during winter when humidity is low and tends to be dry, thereby leaving room for improving humidity modifying effect.

The present invention has been made by taking the above circumstances into consideration. The present invention provides a humidity modifying auxiliary tool which can expect achievement of superior humidity modifying effect, a humidity modifying member, and to a method for modifying humidity using these.

Solution to Problem

A humidity modifying auxiliary tool according to one embodiment of the present invention is a humidity modifying auxiliary tool capable of being installed in a condition where the humidity modifying auxiliary tool covers a sound hole provided on a body part of a stringed instrument, comprising: a lid portion capable of covering the sound hole; a frame portion provided at a back side of the lid portion, the frame portion being equipped with a humidity modifying sheet retaining portion to retain a humidity modifying sheet to modify humidity of the body part.

A humidity modifying member according to another embodiment of the present invention is a humidity modifying member comprising: a humidity modifying auxiliary tool; and a humidity modifying sheet; wherein: the humidity modifying auxiliary tool is the humidity modifying auxiliary tool mentioned above.

A method for modifying humidity according to another embodiment of the present invention is a method for modifying humidity, comprising: installing a humidity modifying auxiliary tool retaining a humidity modifying sheet onto a sound hole, the sound hole being provided on a body part of a stringed instrument, thereby modifying humidity of the stringed instrument; wherein: the humidity modifying auxiliary tool is the humidity modifying auxiliary tool mentioned above.

Effect of the Invention

With the humidity modifying auxiliary tool according to one embodiment of the present invention, a superior humidity modifying effect with stringed instrument can be expected.

MODE FOR CARRYING OUT THE INVENTION

<Overview>

Figure 1:
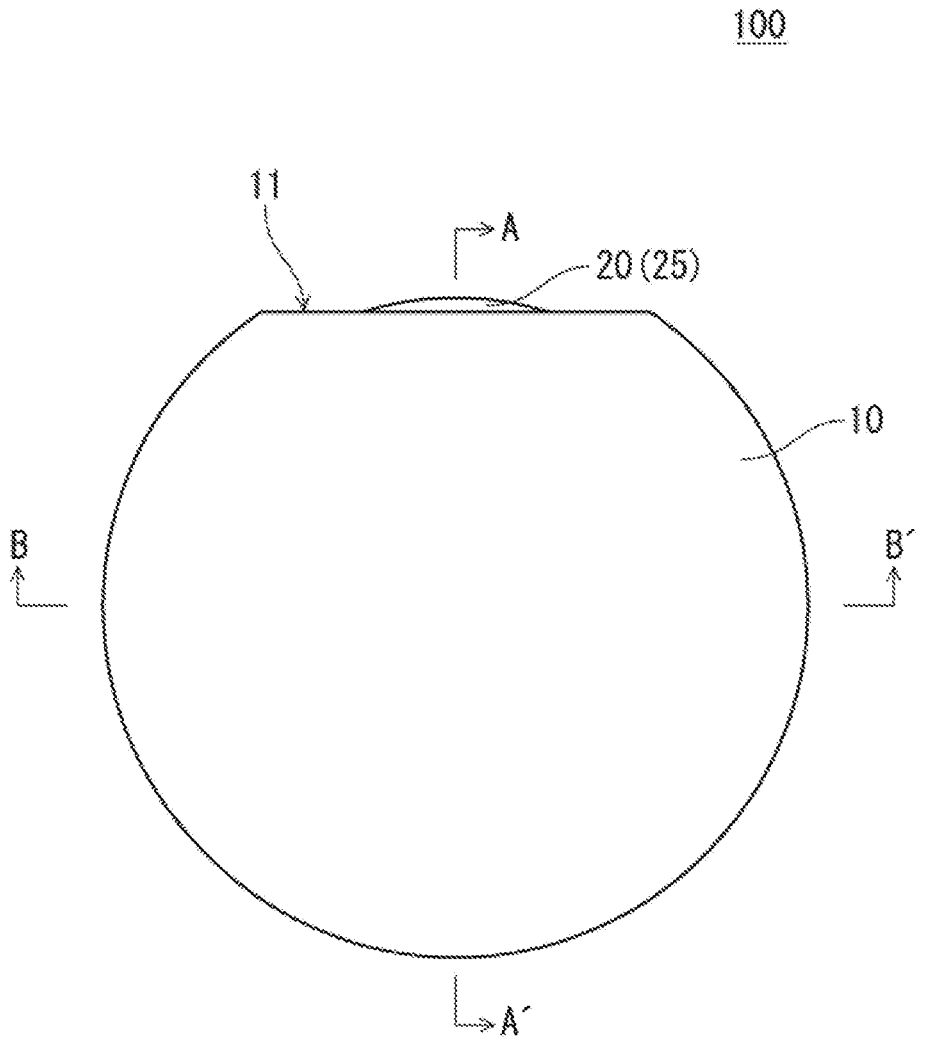
FIG. 1 is a front view of a humidity modifying auxiliary tool according to an embodiment of the present invention.

The humidity modifying auxiliary tool according to an embodiment of the present invention is a humidity modifying auxiliary tool capable of being installed in a condition where the humidity modifying auxiliary tool covers a sound hole provided on a body part of a stringed instrument, comprising: a lid portion capable of covering the sound hole; a frame portion provided at a back side of the lid portion, the frame portion being equipped with a humidity modifying sheet retaining portion to retain a humidity modifying sheet to modify humidity of the body part. With such constitution, a superior humidity modifying effect is realized with stringed instruments such as a guitar and the like.

In a humidity modifying auxiliary tool according to another embodiment, the humidity modifying auxiliary tool is made of silicone rubber. With such constitution, when the humidity modifying sheet is set to a humidity modifying sheet retaining portion, change in the color of the humidity modifying sheet can be observed through the back side of the transparent lid portion made of silicone rubber.

In a humidity modifying auxiliary tool according to another embodiment, the humidity modifying auxiliary tool is capable of being installed in a condition where the humidity modifying auxiliary tool is adhered to the sound hole. With such constitution, the sound hole can be shielded, thereby further improving the humidity modifying effect and a muffling effect can be expected.

In a humidity modifying auxiliary tool according to another embodiment, the stringed instrument is a guitar, ukulele, violin, viola, cello, or contrabass. With such constitution, occurrence of cracks can be prevented with expensive stringed instruments such as a guitar and the like.

In a humidity modifying auxiliary tool according to another embodiment, the sound hole has a circular shape or a shape of letter "f". With such constitution, occurrence of cracks can be prevented with stringed instruments having f-shaped sound hole such as a violin and the like.

Further, a humidity modifying member according to an embodiment of the present invention is a humidity modifying member comprising: a humidity modifying auxiliary tool; and a humidity modifying sheet; wherein: the humidity modifying auxiliary tool is the humidity modifying auxiliary tool mentioned above. With such constitution, a superior humidity modifying effect is realized with stringed instruments such as a guitar and the like.

In a humidity modifying member according to another embodiment, the humidity modifying sheet comprises a humidity modifying layer in which a plurality of gains of silica gel are distributed in a layer structure in between two base material sheets. With such constitution, the humidity modifying effect can be further improved.

In a humidity modifying member according to another embodiment, the humidity modifying sheet is provided with a humidity modifying sensor. With such constitution, condition of humidity modification can be confirmed by observing the change in the color of the humidity modifying sensor.

Further, a method for modifying humidity according to an embodiment of the present invention is a method for modifying humidity, comprising: installing a humidity modifying auxiliary tool retaining a humidity modifying sheet onto a sound hole, the sound hole being provided on a body part of a stringed instrument, thereby modifying humidity of the stringed instrument; wherein: the humidity modifying auxiliary tool is the humidity modifying auxiliary tool mentioned above. With such constitution, humidity of stringed instruments such as a guitar and the like can be modified effectively.

In a method for modifying humidity according to another embodiment, the humidity modifying sheet is first sprayed with water, and then the humidity modifying sheet is set to the humidity modifying sheet retaining portion, thereby modifying humidity of the stringed instrument. With such constitution, occurrence of cracks in the body part can be sufficiently prevented, especially during winter when humidity is low and tends to be dry.

Embodiment

1. Stringed Instrument

There is no particular limitation regarding the stringed instrument. Here, stringed instruments of so called "guitar category" such as a guitar, ukulele and the like, stringed instruments of so called "violin category" such as a violin, viola, cello, contrabass and the like can be mentioned for example.

Here, there is no particular limitation regarding the kind of a guitar, and an acoustic guitar, classical guitar, folk guitar, flamenco guitar, electric acoustic guitar, resonator guitar and the like can be mentioned for example.

2. Sound Hole

There is no particular limitation regarding the shape of the sound hole. Here, a circular sound hole, and a sound hole having a shape of letter "f" (hereinafter referred to as "f hole") can be mentioned for example.

Hereinafter, humidity modifying auxiliary tool as an embodiment of the present invention will be explained with reference to the drawings. Here, the present invention shall not be limited to the following embodiments.

Figure 8:
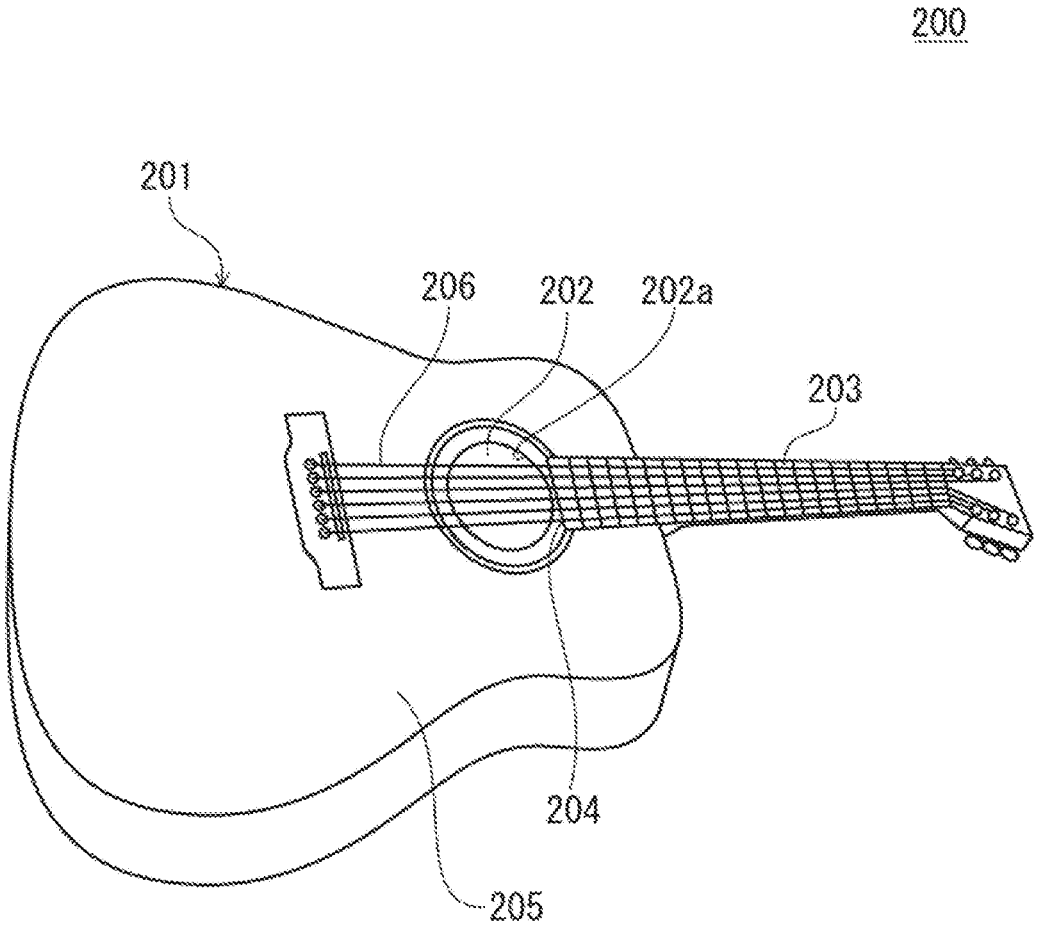
FIG. 8 is a perspective view of a guitar to which the humidity modifying auxiliary tool according to an embodiment of the present invention is installed.

First, as shown in FIG. 8, a case where the stringed instrument is a guitar 200, and the sound hole is a circular sound hole 202 is explained.

Figure 2:
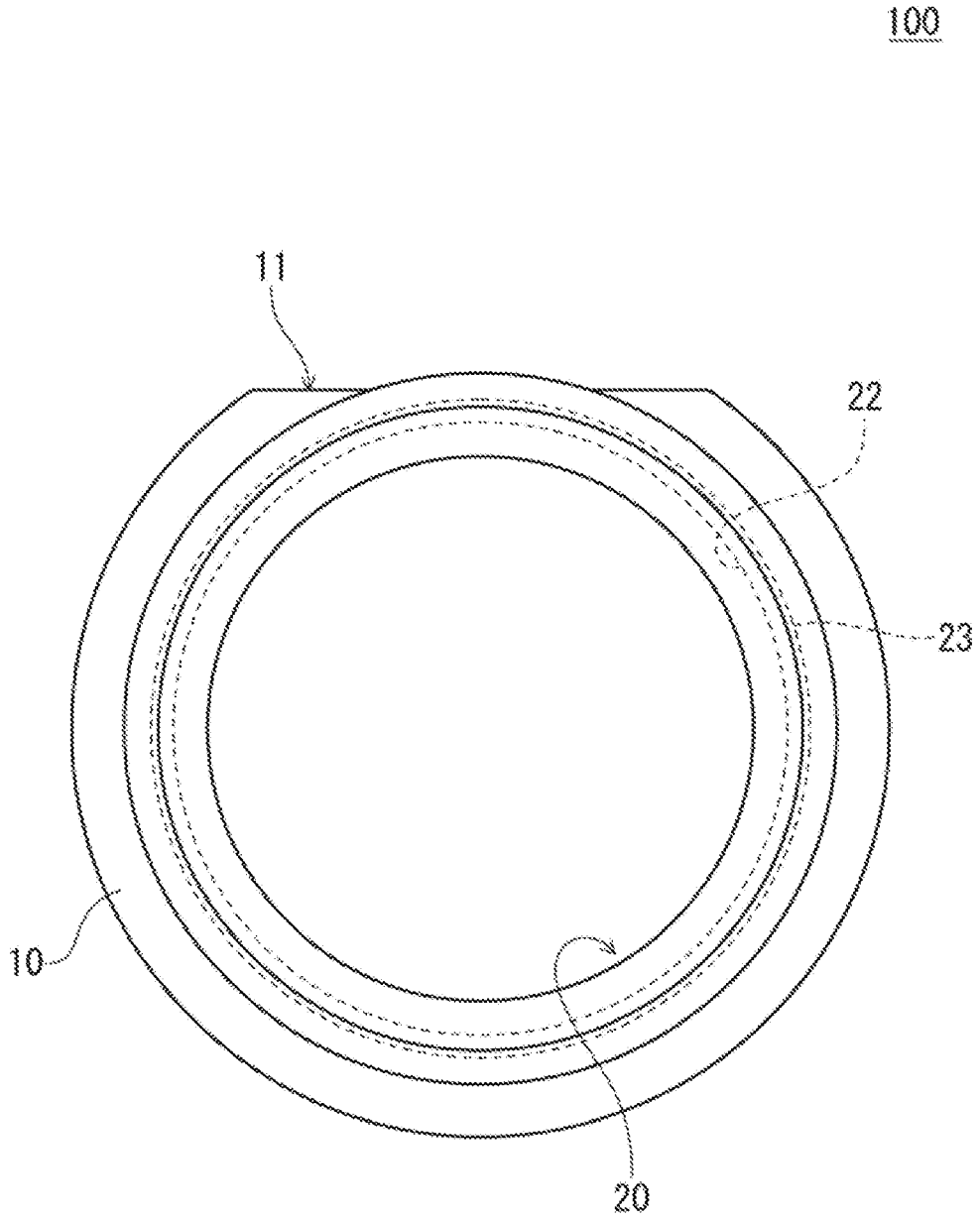
FIG. 2 is a rear view (back view) of a humidity modifying auxiliary tool according to an embodiment of the present invention.
Figure 3:
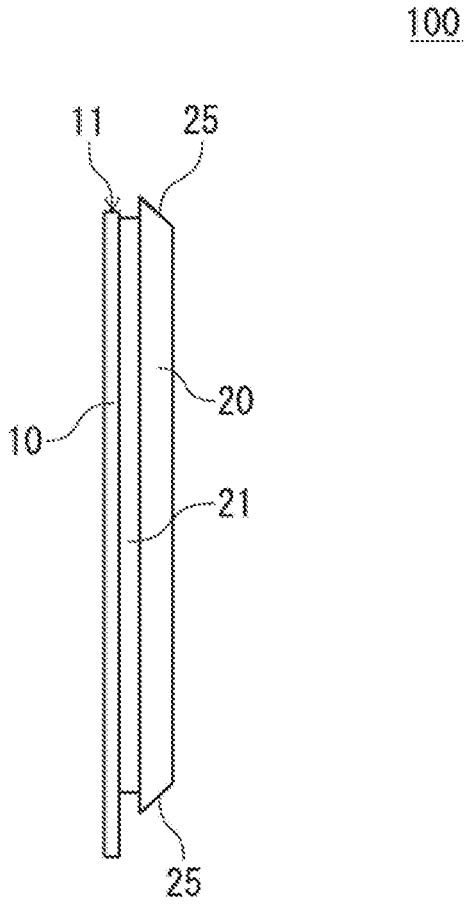
FIG. 3 is a side view of a humidity modifying auxiliary tool according to an embodiment of the present invention.
Figure 4:
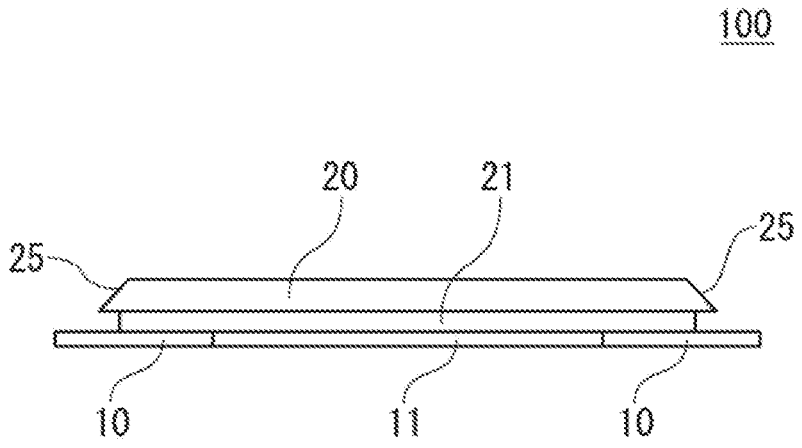
FIG. 4 is a plane view of a humidity modifying auxiliary tool according to an embodiment of the present invention.
Figure 5:
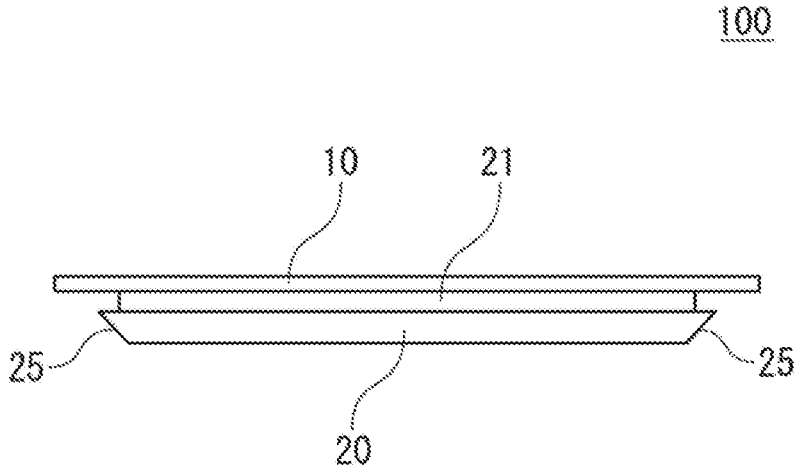
FIG. 5 is a bottom view of a humidity modifying auxiliary tool according to an embodiment of the present invention.
Figure 6:
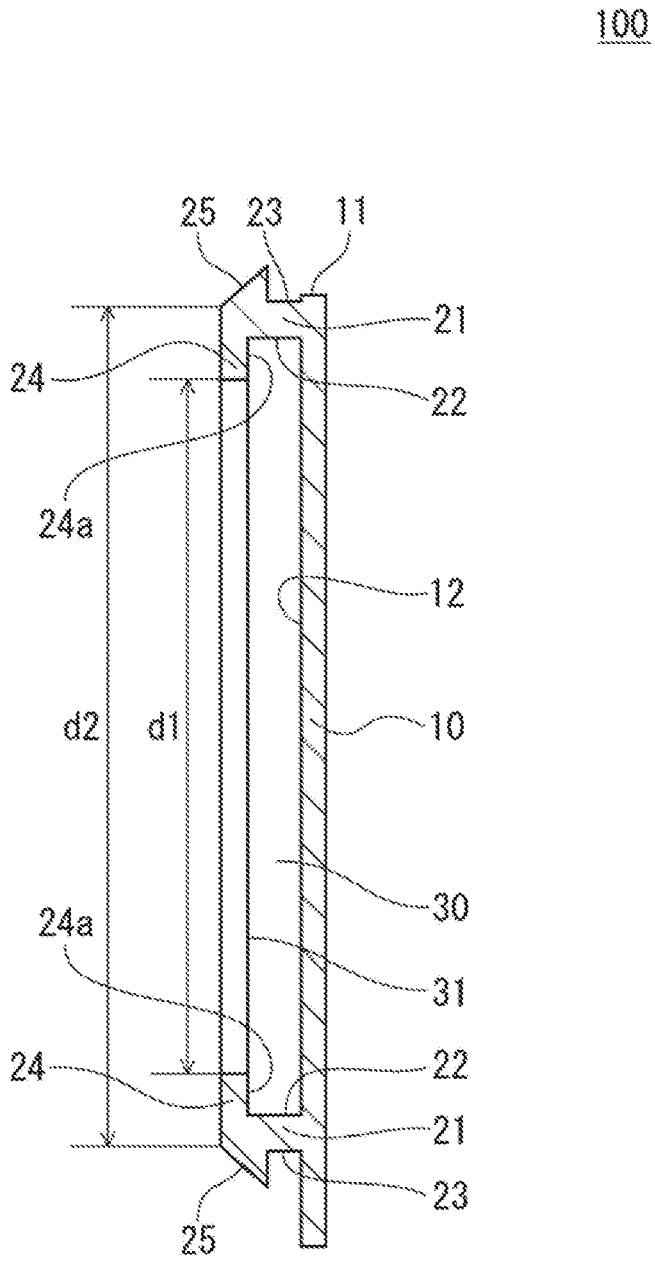
FIG. 6 is a cross sectional view along line A-A' of the humidity modifying auxiliary tool shown in FIG. 1.
Figure 7:
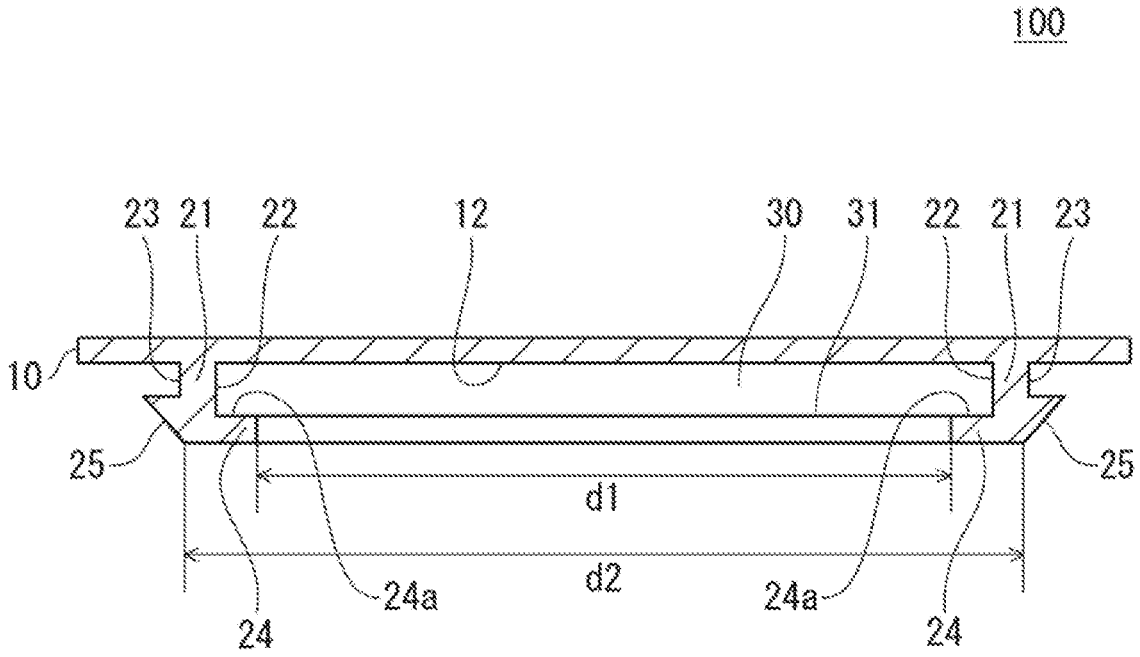
FIG. 7 is a cross sectional view along line B-B' of the humidity modifying auxiliary tool shown in FIG. 1.

FIG. 1 is a front view of humidity modifying auxiliary tool 100 according to an embodiment of the present invention. FIG. 2 is a rear view (back view) of humidity modifying auxiliary tool 100. FIG. 3 is a side view of humidity modifying auxiliary tool 100. FIG. 4 is a plane view of humidity modifying auxiliary tool 100. FIG. 5 is a bottom view of humidity modifying auxiliary tool 100. FIG. 6 is a cross sectional view along line A-A' of humidity modifying auxiliary tool 100 shown in FIG. 1. FIG. 7 is a cross sectional view along line B-B' of the humidity modifying auxiliary tool 100 shown in FIG. 1. FIG. 8 is a perspective view of guitar 200 to which humidity modifying auxiliary tool 100 is installed.

1. Overall Configuration

Explanation will be provided referring mainly to FIG. 1 to FIG. 8.

The humidity modifying auxiliary tool 100 according to the present embodiment comprises an approximately circular lid portion 10, and a donut shaped frame portion 20 equipped with a humidity modifying sheet retaining portion 30.

The humidity modifying auxiliary tool 100 according to the present embodiment is installed so as to cover a circular sound hole (resonance hole) 202 provided to a hollow body part (body) 201 of a stringed instrument (guitar 200 in this case). When the humidity modifying auxiliary tool 100 shown in FIG. 1 and FIG. 2 is installed to the sound hole 202 shown in FIG. 8, the lid portion 10 is held upwards and the frame portion 20 faces the sound hole 202.

Hereinafter, each of the portions will be explained.

2. Lid Portion

Explanation will be provided referring mainly to FIG. 1 to FIG. 7.

The lid portion 10 is an approximately circular sheet which is larger than the outer diameter of the sound hole 202. The lid portion 10 has an edge region 11 cut out by a straight line parallel to B-B' line. This edge region 11 is in the proximity of or is in contact with the end portion 204 of the neck 203 of the guitar 200 shown in FIG. 8 when installed to the sound hole 202.

3. Frame Portion

Explanation will be provided referring mainly to FIG. 1 to FIG. 7.

The frame portion 20 is provided in parallel with respect to the lid portion 10.

When observed from the back side of the lid portion 10, the frame portion 20 has a so called donut shape in which the central portion is hollow. Here, the back side of the lid portion 10 is a plane at the side which directly comes in contact with the sound hole 202, that is, a plane at the side which face the sound hole 202.

3-1. Pillar Portion

The frame portion 20 is provided in parallel with respect to the lid portion 10.

As shown in FIG. 7, when observed from the cross section, the frame portion 20 is provided with a pillar portion 21 which extends in an approximately perpendicular direction with respect to the back side of the lid portion 10.

The pillar portion 21 is a component which connect the frame portion 20 and the lid portion 10, and is formed as a cylinder at the back side of the lid portion 10.

An inner circumferential surface 22 of the pillar portion 21 corresponds to the outer diameter of the humidity modifying sheet retaining portion 30.

The outer circumferential surface 23 of the pillar portion 21 adheres with the rim of the sound hole 202. Further, the height of the outer circumferential surface 23 of the pillar portion 21 is approximately the same as the thickness of the plate material 205 of the body part 201 forming the sound hole 202. Accordingly, the outer circumferential surface 23 of the cylindrical pillar portion 21 fits tightly into the rim of the sound hole 202, thereby allowing to shield the sound hole 202. Therefore, when the instrument is played with the humidity modifying auxiliary tool 100 according to the present embodiment being installed to the sound hole 202, a muffling effect can be achieved. Here, when only the muffling effect is expected and the humidity modifying effect is not necessary, only the humidity modifying auxiliary tool 100 can be used without setting the humidity modifying sheet 1 (shown in FIG. 9) to the humidity modifying sheet retaining portion 30.

3-2. Fixing Portion

Explanation will be provided referring mainly to FIG. 6 and FIG. 7.

At the inner circumferential side of the other end of the pillar portion 21 (opposite side of the lid portion 10), a fixing portion 24 of humidity modifying sheet 1 (shown in FIG. 9) is formed so as to extend out in a parallel direction with the lid portion 10, from the outer circumferential side towards the inner circumferential side. Accordingly, the humidity modifying sheet 1 set in the humidity modifying sheet retaining portion 30 can be prevented from falling out.

3-3. Tapered Portion

Explanation will be provided referring mainly to FIG. 3 to FIG. 7.

At the outer circumferential side of the other end of the pillar portion 21 (opposite side of the lid portion 10), a tapered portion 25 is formed so as to smoothly slope from the inner circumferential side towards the outer circumferential side. Accordingly, attaching/detaching of the frame portion 20 to the sound hole 202 becomes easy.

3. Humidity Modifying Sheet Retaining Portion

Explanation will be provided referring mainly to FIG. 6 and FIG. 7.

The humidity modifying sheet retaining portion 30 is a disc shaped hollow formed with the inner circumferential surface 22 of the cylindrical pillar portion 21, the back side 12 of the lid portion 10, and a virtual plane 31 facing the back side 12. Here, the virtual plane 31 is a plane which is formed by extending out the bottom surface 24*a* of the fixing portion 24 in parallel with the back side 12. The humidity modifying member having the humidity modifying sheet 1 set in the humidity modifying sheet retaining portion 30 is installed in the sound hole 202, thereby allowing to modify humidity of the guitar 200.

4. Size 4-1. Lid Portion

The outer diameter of the lid portion 10 is not particularly limited so long as it is larger than the outer diameter of the sound hole 202. Here, the outer diameter of the lid portion 10 is 120 mm. In addition, there is no particular limitation with the thickness of the lid portion 10, and is 2.5 mm in this case.

The size of the sound hole 202 usually differ by the manufacturer of the guitar. The outer diameter in this case is 95 mm.

4-2. Frame Portion

The size of the frame portion 20 is not particularly limited so long as it can be inserted into the sound hole 202. Here, the outer diameter (d2) of the frame portion 20 is 98 mm.

The inner diameter (d1) of the frame portion 20 is not particularly limited so long as it can fix the humidity modifying sheet 1, and is 80 mm in this case.

The diameter of the tapered portion 25 of the frame portion 20 is preferably enlarged equal to or larger than the outer diameter of the sound hole 202. Here, the diameter of the tapered portion 25 is enlarged to a range of 98 mm to 105 mm.

The width of the bottom surface 24*a* (a portion protruding from the outer circumference to the inner circumference) of the fixing portion 24 is not particularly limited so long as it can prevent falling out of the humidity modifying sheet 1 set in the humidity modifying sheet retaining portion 30. Here, the width is 5 mm in this case. Further, the thickness of the fixing portion 24 is not particularly limited, and is 3 mm in this case.

The height of the outer circumferential surface 23 of the pillar portion 21 is preferably approximately the same as the thickness of the plate material 205 forming the sound hole 202, and is 3.5 mm in this case.

4-3. Humidity Modifying Sheet Retaining Portion

The height of the inner circumferential surface 22 of the pillar portion 21, that is, the height of the humidity modifying sheet retaining portion 30, is preferably approximately the same as the thickness of the humidity modifying sheet 1, and is 6 mm in this case.

The outer diameter of the humidity modifying sheet retaining portion 30 is not particularly limited so long as the humidity modifying sheet 1 can be set, and is 90 mm in this case.

5. Material

Regarding the humidity modifying auxiliary tool 100 according to the present embodiment, the lid portion 10 and the frame portion 20 can be made from the same material, or can be made from a different material. Here, in this case, the lid portion 10 and the frame portion 20 are formed by integral molding from the same material.

The material of the humidity modifying auxiliary tool 100 according to the present embodiment is not particularly limited, and is silicone rubber (hardness: Hs=50) in this case.

Since the silicone rubber is transparent and is excellent in visibility, change in the color of the humidity modifying sheet 1 set in the humidity modifying sheet retaining portion 30 located at the back side of the lid portion 10 can be visually observed through the lid portion 10. Accordingly, degree of humidity modification can be understood.

6. Humidity Modifying Member

The humidity modifying member according to the present embodiment comprises a humidity modifying auxiliary tool (humidity modifying auxiliary tool 100 in this case), and a humidity modifying sheet.

Hereinafter, humidity modifying sheet will be explained in detail.

7. Humidity Modifying Sheet

Figure 9:
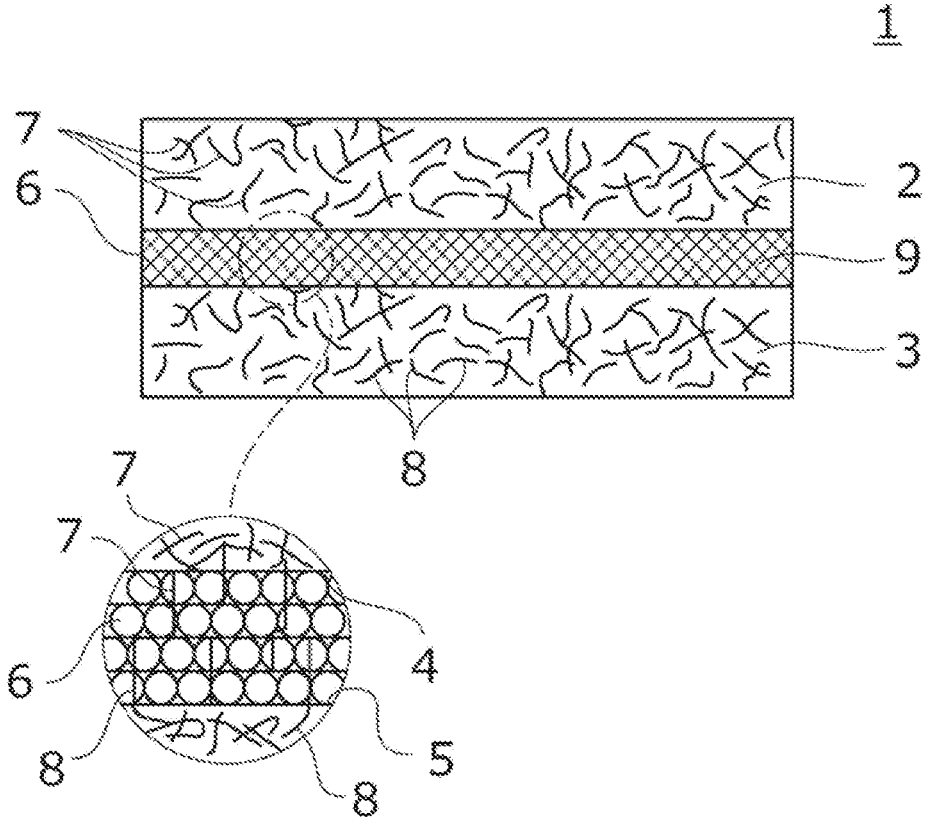
FIG. 9 is a cross sectional view showing a schematic configuration of a humidity modifying sheet used in the humidity modifying auxiliary tool according to an embodiment of the present invention.

Explanation will be provided referring mainly to FIG. 9.

FIG. 9 is a cross sectional view showing a schematic configuration of the humidity modifying sheet 1 used in the humidity modifying member according to the present embodiment.

The humidity modifying sheet 1 is structured by forming a humidity modifying layer 9 by laminating base material sheet 2 and base material sheet 3, and then allowing silica gel 6 comprising a plurality of granules be sandwiched between the laminated surfaces 4 and 5. The humidity modifying sheet 1 can be manufactured, for example, by forming a humidity modifying layer 9 by sandwiching silica gel 6 comprising a plurality of granules between the base material sheet 2 and the base material sheet 3, and then fixing the silica gel 6 by suture, heat welding, and the like.

The humidity modifying sheet 1 is flexible and has air permeability. Further, a material having a humidity modifying function is provided inside the humidity modifying sheet 1.

7-1. Base Material Sheet

There is no particular limitation regarding the base material sheets 2 and 3. Preferably, the base material sheets have air permeability, and can permeate air and moisture. For example, nonwoven fabrics, woven fabrics, knitted fabrics and the like are used. As the material of the base material sheets 2 and 3, for example, polyester resin such as polyethylene terephthalate (PET) and the like, synthetic resins such as polypropylene resin and the like, and rayon and the like can be used. The base material sheet 2 is an aggregate of web 7, and the base material sheet 3 is similarly an aggregate of web 8.

7-2. Humidity Modifying Layer

The material of the humidity modifying layer 9 is not particularly limited so long as it has a humidity modifying function. For example, silica gel, natural porous stones such as zeolite and tourmaline, charcoal such as Binchotan, activated charcoal, perlite, sodium silicate and the like can be mentioned. These can be used alone, or two or more of these can be used in combination. Among these, silica gel is preferably used in terms of superior humidity modifying function and deodorization function, and prompt effect. Silica gel also shows deodorization function by adsorption of not only moisture but also air-scattering substances such as ammonia, trimethylamine, hydrogen sulfide, mercaptan which are source of smell, and nonenal gas which is a source of odor of old age.

As shown in FIG. 9, the humidity modifying layer 9 has a layer structure (four layers shown in the Figure) in between the base material sheets 2 and 3, and is an aggregate of a plurality of silica gel 6 uniformly distributed throughout the entirety in between the facing surfaces 4 and 5 of the base material sheets 2 and 3. As shown in the enlarged figure of FIG. 9, in a condition where the silica gel 6 is sandwiched from upper and lower sides, the facing surfaces 4 and 5 of the base material sheets 2 and 3 are sutured to each other by the webs 7 and 8 which are the constituting material of the base material sheets 2 and 3.

In order to fix silica gel 6, with the silica gel 6 being sandwiched from the upper and lower sides, the overlapping portion of the base material sheet 2 and the base material sheet 3 are provided with needle punch at a plurality of positions. That is, at each of the position of the needle punch, the webs 7 and 8 of the base material sheet 2 and the base material sheet 3 are mechanically entangled. The base material sheet 2 and the base material sheet 3 are bonded and fixed at the vicinity of the entangled position. Accordingly, silica gel 6 in a layer structure is sandwiched and retained unmovably by the base material sheet 2 and the base material sheet 3 sutured at the facing surface 4 and facing surface 5 by the webs 7 and 8.

The grains of silica gel 6 have a plurality of micro-through holes, and have a function to absorb moisture in air by surface adsorption or capillary action under high humidity conditions, and a function to release the adsorbed moisture under dry conditions. Accordingly, in order to improve humidity modifying function and humidity releasing function, the silica gel 6 used in the present embodiment has a micro-space volume of 0.5 to 1.0 ml/g and a surface area of 650 to 350 $m^2/g$.

Further, the bore diameter of the micro-through hole is preferably 30 to 120 angstrom in terms of realizing superior humidity modifying function and the like.

As discussed, by sandwiching the plurality of grains of silica gel 6 with the base material sheet 2 and the base material sheet 3, high humidity modifying characteristics, moisture-proof characteristics, and deodorant characteristics can be maintained for a long period of time.

The size of the humidity modifying sheet 1 is set appropriately depending on the size of the humidity modifying sheet retaining portion 30. Here, the thickness of the humidity modifying sheet 1 is 6 mm.

The humidity modifying sheet 1 can be used repeatedly by drying the humidity modifying sheet 1 under the sun to restore the humidity modifying function.

7-3. Humidity Modifying Sensor

The humidity modifying sheet 1 can be provided with a humidity modifying sensor.

The humidity modifying sensor can be prepared, for example, by applying a predetermined amount of cobalt chloride on the surface. The cobalt chloride is blue in an anhydrous condition, and turns purple when forms a dihydrate due to increase in moisture of the atmosphere, and further turns pink when forms a hexahydrate due to further increase in moisture. The degree of humidity modification can be understood by visually observing the change in the color.

In winter where the humidity is low and tends to be dry, it is preferable to first spray the humidity modifying sheet 1 with water using an atomizer and the like, confirming that the color of the humidity modifying sensor has turned pink, and then set the humidity modifying sheet in the humidity modifying sheet retaining portion 30. When it is determined from the color change that the degree of humidity modification has become small, water can be sprayed using the atomizer and the like, thereby moistening the humidity modifying sheet 1 using the color change as a guideline.

There is no particular limitation regarding the position of the humidity modifying sensor. Here, it is preferable to position the humidity modifying sensor not in the center portion but in the peripheral portion of the humidity modifying sheet 1. It is preferable to set the humidity modifying sheet 1 in the humidity modifying sheet retaining portion 30 with the humidity modifying sensor located on the upper side, so that the humidity modifying sensor can be observed via the lid portion 10.

8. Method for Modifying Humidity

The humidity modifying member according to the present embodiment is installed so as to cover the sound hole 202 provided in the hollow body part 201 of a stringed instrument (guitar 200 in the present embodiment), from between the sound hole 202 and a plurality of strings 206 stretched over the body part 201. Specifically, the humidity modifying sheet 1 is prepared, and then the humidity modifying sheet 1 is inserted into the humidity modifying sheet retaining portion 30. The humidity modifying member is then installed by allowing the humidity modifying sheet 1 side to face the inner side of the body part 201, in a condition where the lid portion 10 is covering the sound hole 202. When used especially in winter where the humidity is low and tends to be dry, it is preferable to use the humidity modifying sheet 1 in a condition where humidity is enhanced, by spraying the humidity modifying sheet 1 with water using an atomizer and the like.

Alternative Example

The humidity modifying auxiliary tool according to one embodiment has been explained. However, the present invention shall not be limited to such embodiment, and can be altered as in the following alternative example. Further, the embodiment and the alternative example can be combined, or the alternative examples can be combined with each other. In addition, examples not described in the embodiment or the alternative example, and change in design within the extent not deviating the gist of the invention are also included in the present invention.

1. Pillar Portion

In the embodiment, the outer circumferential surface 23 of the pillar portion 21 is adhered to the rim of the sound hole 202, thereby shielding the sound hole 202. However, it would not be problematic even when there is some gap.

2. Lid Portion

The lid portion 10 of the embodiment has an edge region 11 cut out by a straight line parallel with line B-B'. However, the lid portion 10 can have a circular shape without the edge region 11.

In addition, the lid portion 10 is not limited to a circular shape, so long as it can cover the sound hole 202. The lid portion 10 can have a polygonal shape such as a square, triangle, and the like.

3. Frame Portion

The frame portion 20 of the embodiment is provided so as to be parallel with the lid portion 10. However, the frame portion 20 can be provided so as to be perpendicular with the lid portion 10. That is, the humidity modifying sheet retaining portion 30 can be formed perpendicularly with the lid portion 10, and the humidity modifying sheet 1 can be retained therein.

4. Stringed Instrument

Figure 10:
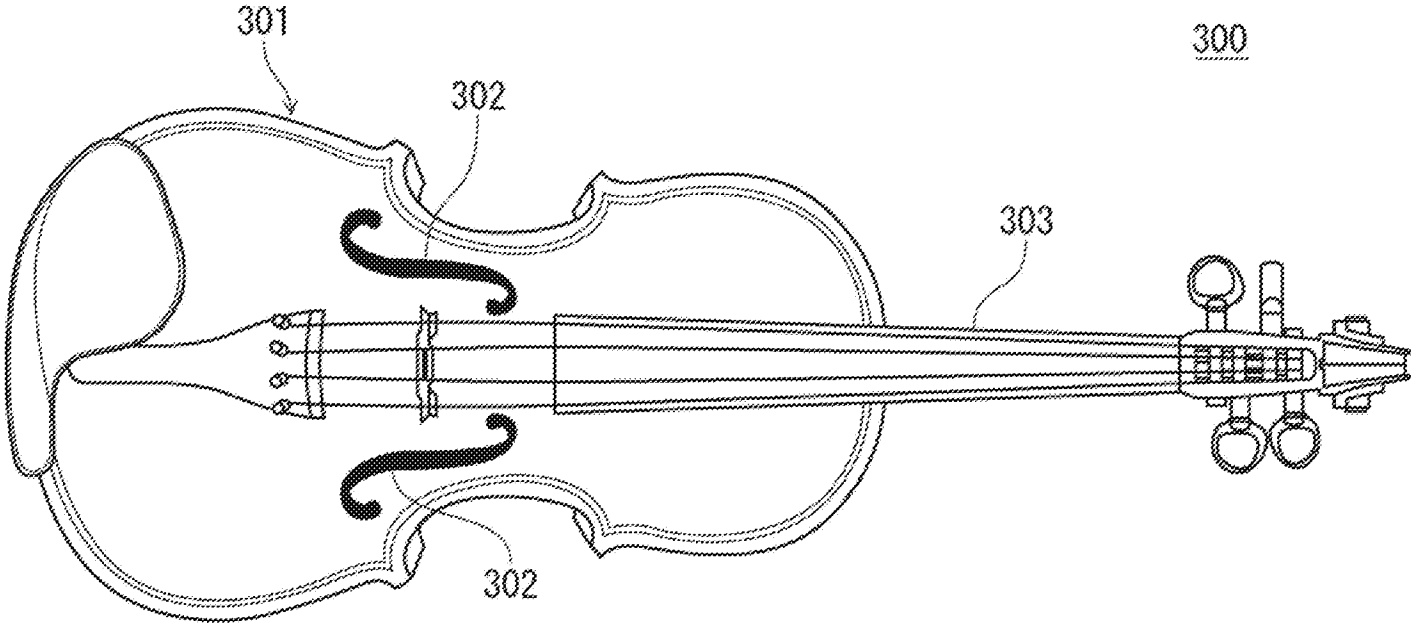
FIG. 10 is a front view of a violin to which the humidity modifying auxiliary tool according to an embodiment of the present invention is installed.

In the embodiment, guitar 200 was used as the stringed instrument. However, the stringed instrument is not limited to such, and the invention can be applied to a violin 300 as shown in FIG. 10. Here, in the figure, 301 shows a body part, and 303 shows a neck.

Further, the humidity modifying auxiliary tool according to the embodiment can be applied to stringed instruments such as an ukulele, viola, cello, contrabass and the like.

5. Sound Hole

In the embodiment, a circular sound hole 202 was explained. However, there is no particular limitation regarding the shape of the sound hole, and can be, as shown in FIG. 10 for example, a f hole 302 having a shape of letter "f", or can be an oval shape and the like.

In the embodiment, a case where the number of the sound hole was one was explained. However, there is no particular limitation regarding the number of the sound hole, and can be, as shown in FIG. 10 for example, two, three or more.

EXPLANATION OF SYMBOLS

1 humidity modifying sheet
10 lid portion
20 frame portion
30 humidity modifying sheet retaining portion
100 humidity modifying auxiliary tool
200 guitar
201 body part

The invention claimed is:

1. A method for modifying humidity, comprising:

installing a humidity modifying auxiliary tool retaining a humidity modifying sheet onto a sound hole, the sound hole being provided on a body part of a stringed instrument, thereby modifying humidity of the stringed instrument;

wherein the humidity modifying auxiliary tool is capable of being installed in a condition where the humidity modifying auxiliary tool covers a sound hole provided on a body part of a stringed instrument, wherein the humidity modifying auxiliary tool comprises:

a lid portion capable of covering the sound hole; and a frame portion provided at a back side of the lid portion, the frame portion being equipped with a humidity modifying sheet retaining portion to retain a humidity modifying sheet to modify humidity of the body part, and wherein the humidity modifying sheet is first sprayed with water, and then the humidity modifying sheet is set to the humidity modifying sheet retaining portion, thereby modifying humidity of the stringed instrument.

2. A humidity modifying auxiliary member comprising:

a humidity modifying auxiliary tool is made of silicone rubber, the humidity modifying auxiliary tool being installed in a condition where the humidity modifying auxiliary tool is adhered to a sound hole provided on a body part of a stringed instrument; and a humidity modifying sheet that modifies humidity of the body part, wherein:

the humidity modifying sheet comprises a humidity modifying layer in which a plurality of gains of silica gel are distributed in a layer structure in between two base material sheets, wherein the humidity modifying auxiliary tool comprises:

a lid portion that covers the sound hole, the lid portion being a circular sheet which is larger than the outer diameter of the sound hole;

a frame portion provided at a back side of the lid portion, the frame portion having a donut shape in which the central portion is hollow and being parallel to the back side of the lid portion; and a cylindrical pillar portion that extends in a perpendicular direction with respect to the back side of the lid portion, and that connects the frame portion and the lid portion, wherein the humidity modifying sheet is inserted into a humidity modifying sheet retaining portion from a side of the cylindrical pillar portion, the humidity modifying sheet retaining portion being a disc shaped hollow formed with an inner circumferential surface of the cylindrical pillar portion, the back side of the lid portion, and a virtual plane facing the back side, and wherein a surface of the humidity modifying sheet is exposed through the central portion of the frame portion having the donut shape to an inner space of the body part of the stringed instrument.

3. The humidity modifying auxiliary member of claim 2, wherein an outer peripheral side surface of the frame portion has a tapered shape in which a maximum outer diameter of the frame portion is enlarged equal to or larger than the outer diameter of the sound hole.

4. The humidity modifying auxiliary member of claim 3, including a humidity modifying sensor that comprises cobalt chloride applied on the surface of the humidity modifying sheet.

* * * * *